US006332612B1

(12) United States Patent
Kanemura

(10) Patent No.: US 6,332,612 B1
(45) Date of Patent: Dec. 25, 2001

(54) ELECTROSTATIC SHEET CONVEYOR CONTROL BASED ON DETECTION OF PARTICULAR ASPECTS OF ELECTRODE GROUPS AND RECORDING APPARATUS HAVING SAME

(75) Inventor: Shoji Kanemura, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/594,492

(22) Filed: Jun. 16, 2000

(30) Foreign Application Priority Data

Jun. 23, 1999 (JP) ..... 11-176926

(51) Int. Cl.[7] ..... B65H 5/02; B65H 15/00

(52) U.S. Cl. ..... 271/275; 198/472.1

(58) Field of Search ..... 271/275, 18.1, 271/193; 198/472.1, 867.04, 803.6, 861, 377.03, 377.09, 691

(56) References Cited

U.S. PATENT DOCUMENTS 4,244,465 * 1/1981 Hishikawa et al. ..... 198/691 X
5,003,325 * 3/1991 Bibl ..... 346/136 X
5,531,436 * 7/1996 Ohyama et al. ..... 271/275 X

* cited by examiner

*Primary Examiner*—Christopher P. Ellis
*Assistant Examiner*—Kenneth W Bower
(74) *Attorney, Agent, or Firm*—Fitzpatrick, Cella, Harper & Scinto

(57) ABSTRACT

A sheet conveying apparatus and an image recording apparatus in which an electrode at a particular position on a conveying belt is formed in a particular aspect, whereby the position can be recognized without a marker or the like being discretely required. The sheet conveying apparatus and the image recording apparatus have a conveying belt for conveying a sheet, and comb-teeth electrodes having a plurality of electrodes installed in the conveying direction of the conveying belt, and the electrode at a particular position among the comb-teeth electrodes is formed in a particular aspect, and a probe for detecting the aspect of the electrode is provided, and the operation is controlled on the basis of the information by the probe.

15 Claims, 6 Drawing Sheets

ELECTROSTATIC SHEET CONVEYOR CONTROL BASED ON DETECTION OF PARTICULAR ASPECTS OF ELECTRODE GROUPS AND RECORDING APPARATUS HAVING SAME

BACKGROUND OF THE INVENTION

1. Field of the Invention

This invention relates to a sheet conveying apparatus having a plurality of electrodes disposed to attract and convey a sheet by an electrostatic force, and an image recording apparatus provided with the same.

2. Related Background Art

An ink jet recording apparatus having a sheet conveying apparatus of a conventional electrostatic attraction type will hereinafter be described with reference to the accompanying drawings. FIG. 7 is a schematic cross-sectional view of an image recording apparatus according to the conventional art, and FIGS. 8A and 8B are a plan view and an enlarged cross-sectional view, respectively, of a sheet conveying apparatus. The image recording apparatus 50 shown in FIG. 7 has a recording head 51 for effecting image recording, and a conveying belt 52 which is a sheet conveying apparatus of an electrostatic attraction type. The recording head 51 is of a line type in which discharge openings are arranged over a width substantially equal to the width of a sheet conveyed, and is capable of effecting high-speed image formation as compared with a serial type in which a recording head is carried on a carriage and is caused to scan.

However, because of the high speed, discharged ink is unfixed immediately after recording, and there is the undesirable possibility of an image being disturbed if a recording surface is contacted with a sheet conveying apparatus for holding the sheet. So, in such an apparatus, design is made such that the back side of the recording surface of the sheet is attracted to the conveying belt 52 provided with electrostatic attracting means and the sheet is conveyed without the conveying belt contacting with the recording surface.

The conveying belt 52 is a circular ring-shaped belt member passed over a driving roller 58 and a plurality of supporting rollers 59, 60 and 61, and is rotatively driven to thereby convey the sheet which is a recording medium such as paper or a plastic sheet. As the electrostatic attracting means in this conveying belt 52, there is, for example, one as shown in FIG. 8A wherein a group of electrodes (hereinafter referred to as the comb-teeth electrodes 53 and 54) comprising strip-like electrodes of different polarities alternately disposed are formed and as shown in FIG. 8B, electrically conductive brushes 55 as electricity supplying means are provided on the opposite ends of the conveying belt 52. In such a construction, when one of the comb-teeth electrodes 53 and 54 is connected to earth potential and a predetermined voltage is applied to the other to thereby produce a potential difference, an attracting force can be provided by an electrostatic force.

However, the comb-teeth electrodes 53 and 54 are embedded in the conveying belt 52 and therefore, the thickness of the conveying belt 52 and the hardness of the material thereof vary in the electrode portions and these factors appear as the irregularity of speed in the driving roller 58 portion or the like, and the accuracy of sheet conveyance is reduced. Also, generally the electrode portion is worked by printing or the welding of the electrode materials, but it is difficult to effect such working on an endless belt and therefore, the conveying belt is formed by working it into a band-like belt, and thereafter joining the ends of the belt into an endless shape.

Therefore, the conveying belt 52 does not become a seamless belt of good mechanical accuracy and particularly, the joining portion adversely affects an image in the application thereof to a recording apparatus for the reason that the degree of smoothness thereof is lowered, or causes an inconvenience such as jam or rubbing by the floating of a sheet. Therefore, usually it is necessary to detect the joining portion of the conveying belt, and control the belt so that no sheet may be placed on the joining portion, and a marker 56 has been printed on the conveying belt 52 or a reflecting member has been attached to the conveying belt 52 to thereby effect detection by the use of an optical sensor 57. However, it has required much labor and cost in the manufacture to print the marker 56 on a surface discrete from the electrode pattern or stick it in the form of a seal. Also, the position at which the marker is stuck on the conveying belt has been limited.

SUMMARY OF THE INVENTION

So, the present invention has as its object to provide a sheet conveying apparatus and an image recording apparatus in which an electrode at a particular position on a conveying belt is formed in a particular aspect, whereby the position can be recognized without a marker or the like being discretely required.

To solve the above-noted problems, in the typical construction of a sheet conveying apparatus and an image recording apparatus according to the present invention, the sheet conveying apparatus has a conveying belt for conveying a sheet, a first group of electrodes comprising a plurality of electrodes installed in the conveying direction of the conveying belt, and a second group of electrodes comprising electrodes installed between adjacent ones of the first group of electrodes, the sheet is attracted and conveyed by an electrostatic force produced with a potential difference provided between the first group of electrodes and the second group of electrodes, an electrode of the first or second group of electrodes on the conveying belt which is at a particular position is formed in a particular aspect, and detecting means for detecting the aspect of the electrode is provided on the circumference of the conveying belt so that the operation of the apparatus may be controlled on the basis of the information by the detecting means.

DESCRIPTION OF THE PREFERRED EMBODIMENT

Figure 1:
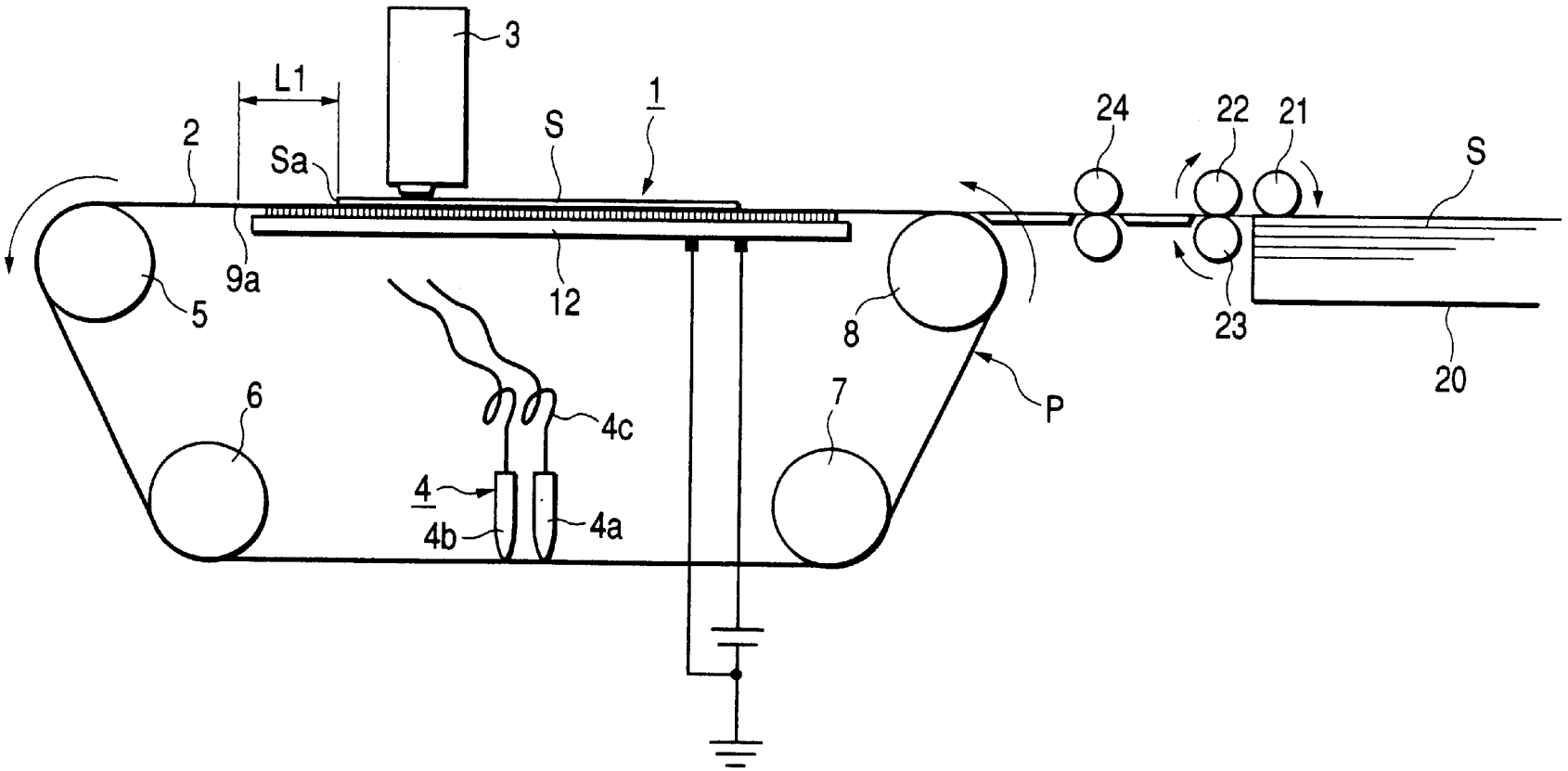
FIG. 1 is a schematic cross-sectional view of an image recording apparatus according to an embodiment of the present invention.
Figure 2A:
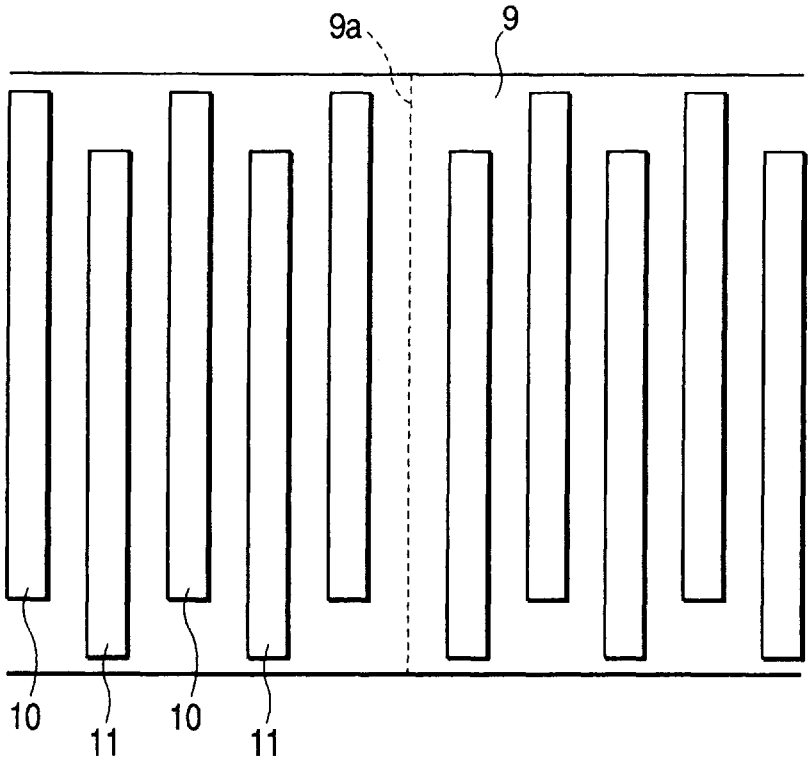
FIGS. 2A and 2B are a plan view and an enlarged cross-sectional view, respectively, of a sheet conveying apparatus.
Figure 2B:
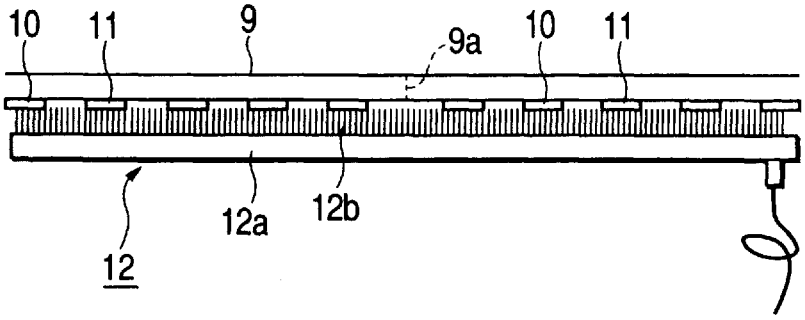
Figure 3:
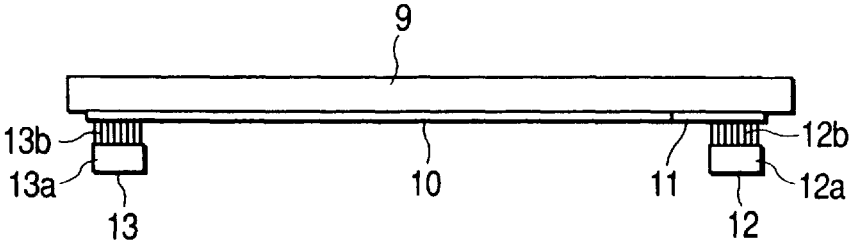
FIG. 3 is a front view of the sheet conveying apparatus.
Figure 4:
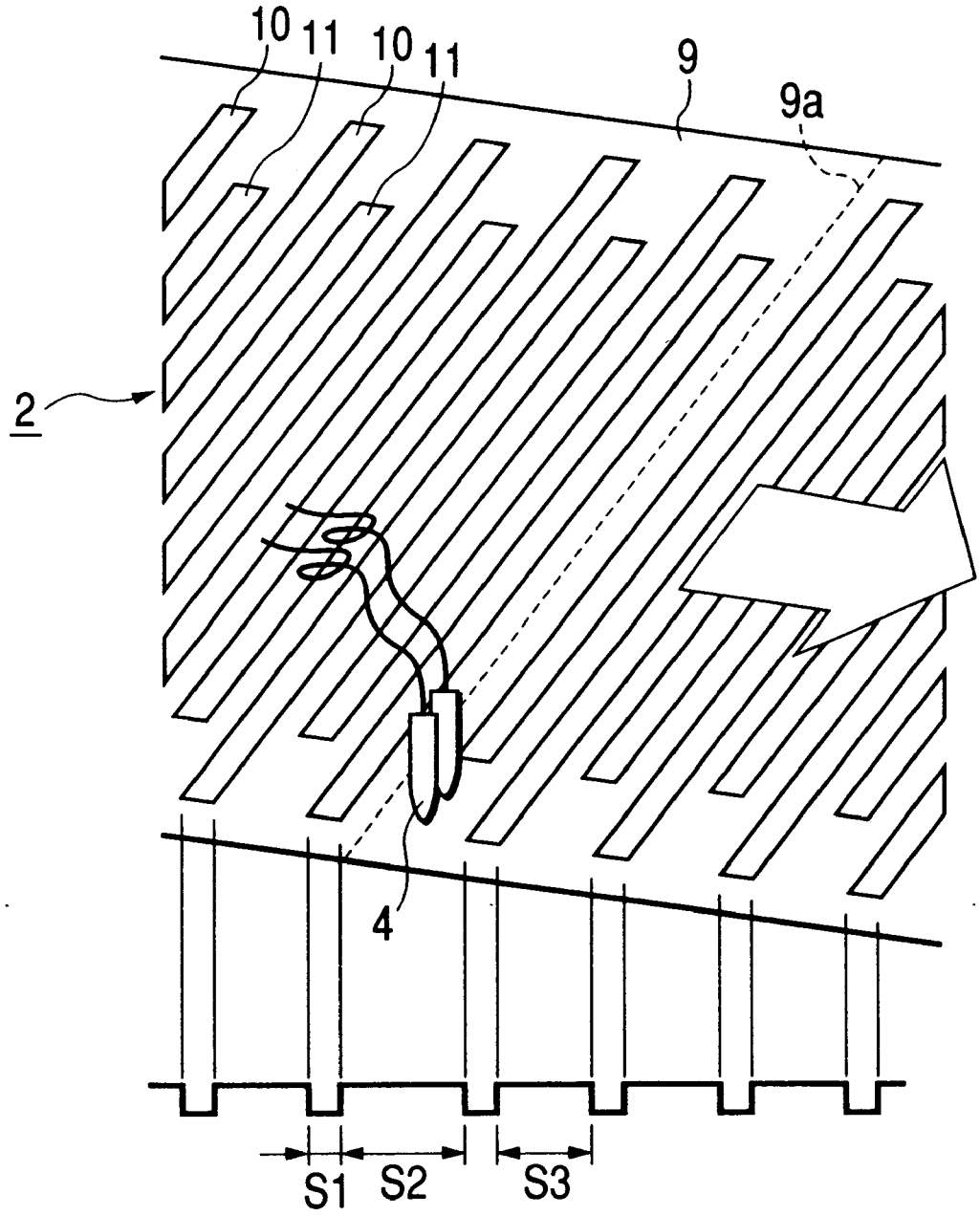
FIG. 4 is a perspective view illustrating the operation of the sheet conveying apparatus.
Figure 5A:
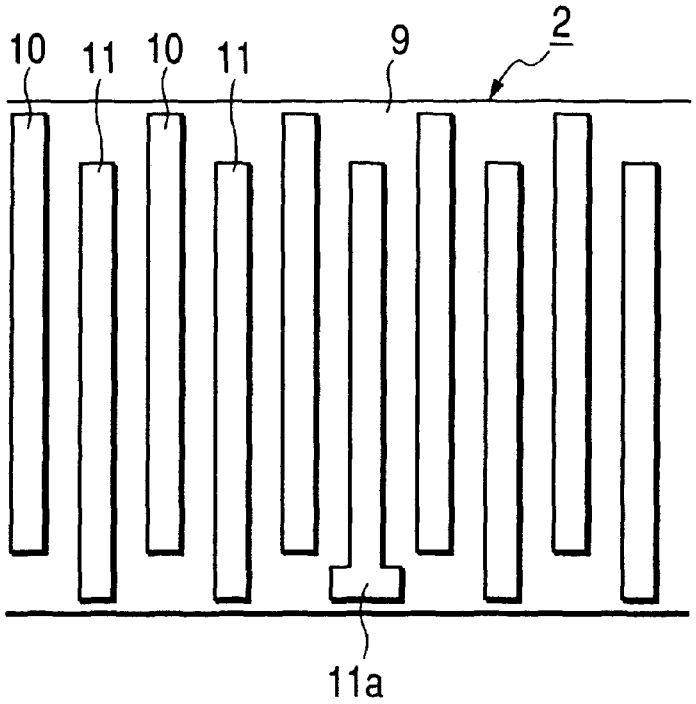
FIGS. 5A and 5B show other constructions of the sheet conveying apparatus.
Figure 5B:
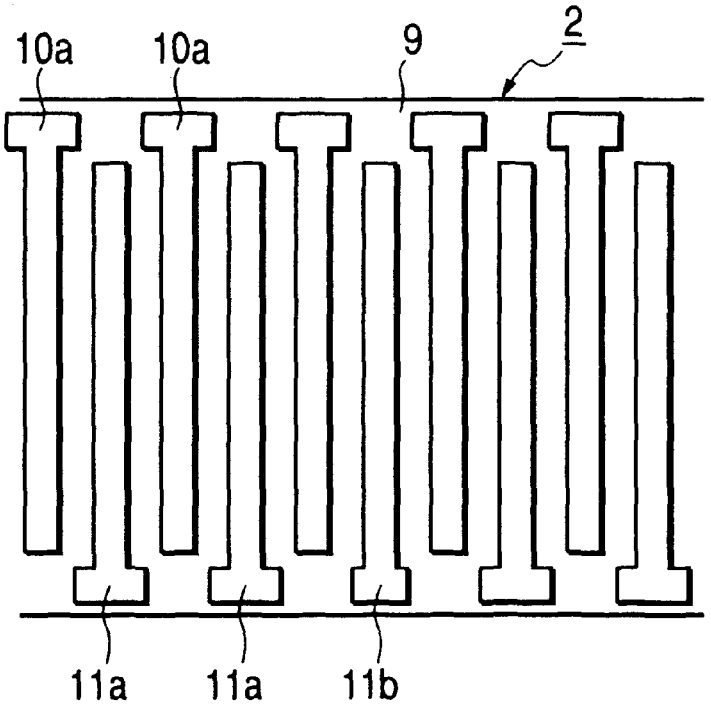

An embodiment of a sheet conveying apparatus and an image recording apparatus according to the present invention will hereinafter be described with reference to the drawings. FIG. 1 is a schematic cross-sectional view of the image recording apparatus according to the present embodiment, FIGS. 2A and 2B are a plan view and an enlarged cross-sectional view, respectively, of the sheet conveying apparatus, FIG. 3 is a front view of the sheet conveying apparatus, FIG. 4 is a perspective view illustrating the operation of the sheet conveying apparatus, and FIGS. 5A and 5B show other constructions of the sheet conveying apparatus.

The image recording apparatus 1 shown in FIG. 1 is an example of the construction adopting the so-called ink jet system, and a recording head 3 is a head of the ink jet type, is driven by a control portion, not shown, and discharges ink droplets to thereby effect recording.

Sheets S stacked on a containing portion 20 are fed out by a sheet pickup roller 21 rotated in the direction indicated by the arrow, and one of the sheets is separated and fed by a feeding roller 22 and a separation roller 23 rotated in the directions indicated by the respective arrows. The sheet S is rammed against the nip between a pair of registration rollers 24 being stopped and is curved, whereby the skew feed thereof is corrected, and the sheet S is conveyed by the pair of registration rollers 24 starting to rotate at predetermined timing, and an image is recorded on the sheet S when it passes under the recording head 3 while being electrostatically attracted to a conveying belt 2 and moved by the conveying belt 2.

The conveying belt 2 which is the sheet conveying apparatus is a circular ring-shaped belt member passed over a driving roller 5 and supporting rollers 6, 7 and 8, and is rotatively driven to thereby convey the sheet S which is a recording medium such as paper or a plastic sheet. This conveying belt 2 has comb-teeth electrodes 10 which are a first group of electrodes and comb-teeth electrodes 11 which are a second group of electrodes as electrostatic attracting means. The first and second groups comprise strip-like electrodes alternately disposed as shown in FIG. 2A on that surface of a dielectric material film layer 9 providing a base which is opposite to the conveying surface. Each of the comb-teeth electrodes 11 is installed between adjacent ones of the comb-teeth electrodes 10, that is, alternately disposed in the conveying direction.

The comb-teeth electrodes 10 and 11 comprise, for example, electrodes having a thickness of 35 $\mu$m and a width of 8 mm disposed at intervals of 8 mm on the surface of the dielectric material film layer 9. As shown in FIGS. 2B and 3, electrically conducting brushes 12 and 13 as electricity supplying means are provided on the opposite ends of the conveying belt 2. The electrically conducting brushes 12 and 13 are comprised of electrically conductive brushes 12*b* and 13*b* implanted on base materials 12*a* and 13*a*, respectively, and contact with the comb-teeth electrodes 10 and 11 of the conveying belt 2 as shown in FIG. 3 to thereby effect the supply of electricity.

When a potential difference is created in the comb-teeth electrodes 10 and 11 thus constructed, an attracting force can be provided by an electrostatic force. In the present embodiment, the electrically conducting brush 13 is grounded. To obtain a predetermined electrostatic force, it is necessary to apply a voltage of the order of 1 to 2 KV to the electrically conducting brush 12. When the conveying belt 2 is rotated, the comb-teeth electrodes 10 and 11 receive the supply of electricity by their sliding contact with the electrically conducting brushes 12 and 13 to thereby produce an electrostatic attracting force, whereby the sheet is attracted to and conveyed by the conveying belt 2.

A probe 4 for detecting one of the comb-teeth electrodes 10 and 11 is further provided in the interior of the conveying belt 2. The probe 4 is comprised of two needles 4*a* and 4*b*, and is disposed at a position whereat it contacts with one of the comb-teeth electrodes 10 and 11 of the conveying belt 2, and detects an electric current flowing through a signal line 4*c* connected to a detecting circuit 31 shown in FIG. 6 to thereby detect the comb-teeth electrodes 10 and 11. Accordingly, when as shown in FIG. 4, the comb-teeth electrodes 11 pass the probe 4, the two needles 4*a* and 4*b* conduct to each other and an electric current flows as indicated by a waveform S1, and the passage of the electrodes and the interval between the electrodes can be recognized.

Here, for the reason in the working of the comb-teeth electrodes 10 and 11, the conveying belt 2 is formed into an endless shape by providing the comb-teeth electrodes 10 and 11 on the belt-shaped dielectric material film layer 9 before joining the ends of the belt together at a joining portion 9*a*. In the present embodiment, as a special aspect of the electrodes, as shown in FIGS. 2A and 2B, the interval between the electrode patterns in this joining portion 9*a* is made wide as compared with the other regions.

Thus, the waveform S2 between the electrodes including the joining portion 9*a* becomes longer than the waveform S3 between the ordinary electrodes, and it becomes possible to distinguish between and recognize these. The image recording apparatus 1 controls sheet feeding means including the sheet pickup roller 21, the registration rollers 24, etc. by control means including a control circuit 30 shown in FIG. 6, and controls the feeding timing so that the sheet S may not catch on the joining portion 9*a*. Thereby the sheet S can be reliably placed on the flat portion of the conveying belt 2, and the conveying speed while the sheet S is being conveyed can be stabilized.

Figure 6:
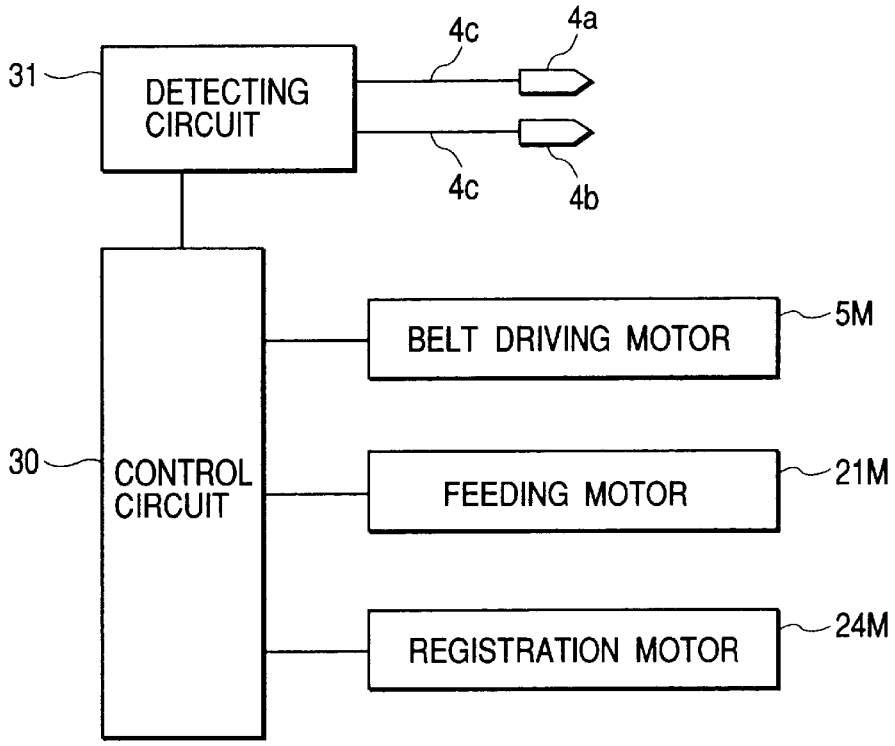
FIG. 6 is a control block diagram showing the control circuit of the sheet conveying apparatus.
Figure 7:
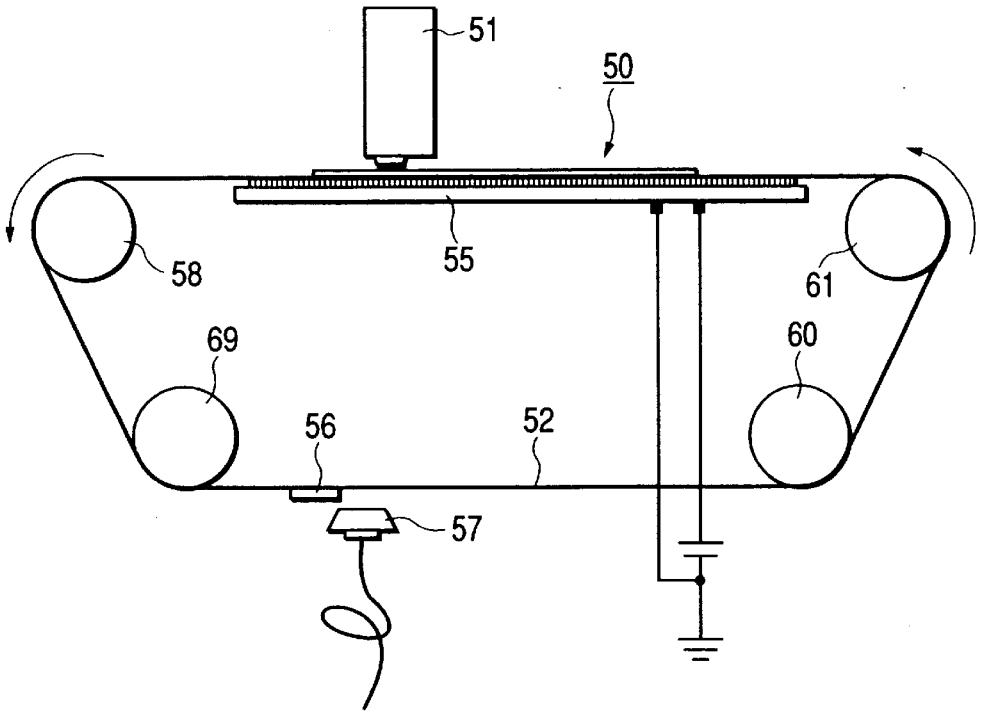
FIG. 7 is a schematic cross-sectional view of an image recording apparatus according to the conventional art.
Figure 8A:
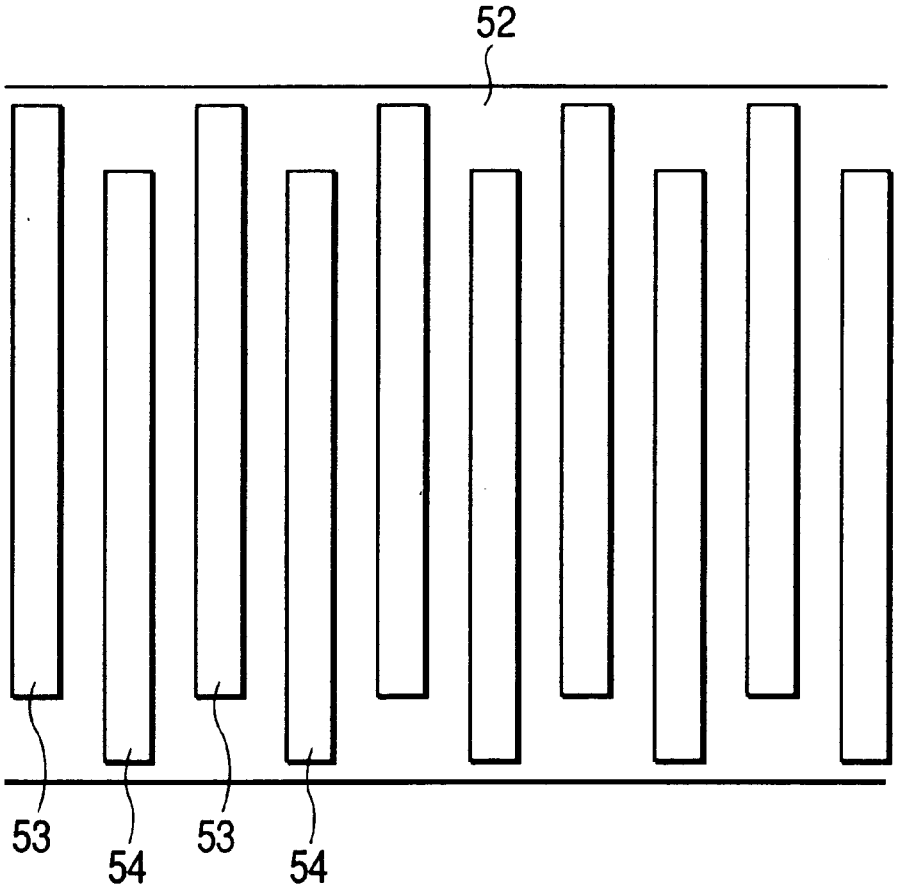
FIGS. 8A and 8B are a plan view and an enlarged cross-sectional view, respectively, of a sheet conveying apparatus.
Figure 8B:
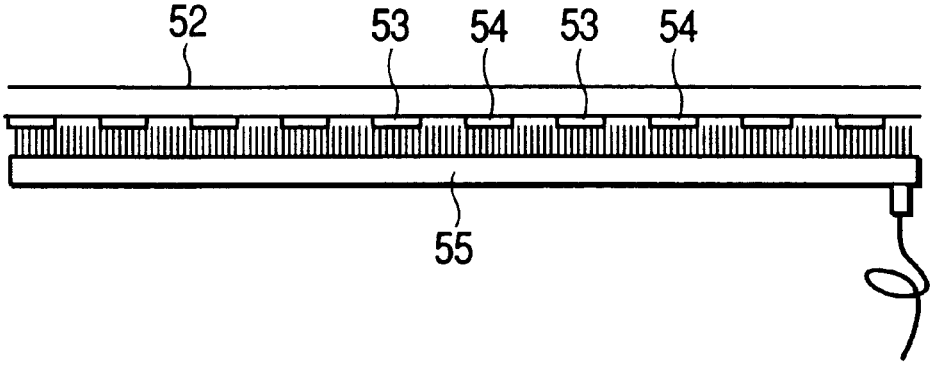

In FIG. 6, the needles 4*a* and 4*b* are connected to the detecting circuit 31. The detecting circuit 31 detects whether the space between the probes 4*a* and 4*b* is in contact with the comb-teeth electrodes 10 or 11 and is closed. The signal thereof is sent as a waveform shown in FIG. 4 to the control circuit 30.

The control circuit 30 controls a belt driving motor 5M for driving the driving roller 5, a feeding motor 21M for driving the sheet pickup roller 21, the feeding roller 22 and the separation roller 23, and a registration motor 24M for driving the registration rollers 24.

The control circuit 30 detects by a signal from the detecting circuit 31 that the joining portion 9*a* has passed the position of the probe 4. Further, it can calculate at what position the joining portion 9*a* is by counting the amount of rotation of the belt driving motor 5M after the joining portion 9*a* has passed the probe 4.

When it receives a sheet pickup signal from an external computer or the like, the control circuit 30 judges whether the joining portion 9*a* is at such a position that overlaps the fed sheet S when the feeding operation has been immediately started. When the control circuit 30 judges that the joining portion 9*a* is at a position which does not overlap the sheet S, it drives the feeding motor 21M so as to intactly start the feeding operation, and drives the registration motor 24M at predetermined timing and causes the sheet S to be attracted to the belt 2.

When the control circuit 30 judges that the joining portion 9*a* is at a position which overlaps the sheet S, the feeding operation is started after the joining portion 9*a* has advanced to a predetermined position (e.g. the position P of FIG. 1).

Or, as shown in FIG. 1, the feeding motor 21M and the registration motor 24M are driven at such timing that the leading end Sa of the fed sheet S is positioned at a distance L1 behind the joining portion 9*a*.

While in the present embodiment, the interval between the electrode patterns including the joining portion 9*a* has been set widely as the special aspect of the electrodes, the present invention is not restricted thereto, but the special aspect of the electrodes may be set at any position from the relations of the position of the probe 4 and the control of feeding.

(Other Embodiments)

While in the above-described embodiment, widening the interval between the electrode patterns as the particular aspect of the electrode at the particular position has been used as an example, the present invention can also be carried out by other aspects.

FIGS. 5A and 5B show examples in which the widths of particular comb-teeth electrodes are made different from each other as other constructions of the sheet conveying apparatus according to the present invention. FIG. 5A shows an example in which a particular comb-teeth electrode 11 is provided with an end portion 11*a* of a great width. In FIG. 5B, comb-teeth electrodes 10 and 11 are provided with end portions 10*a* and 11*a,* and an electrode at a particular position is provided with an end portion 11*b* of a small width. With such constructions, a difference occurs to the waveform S1 when the probe 4 passes the electrodes and therefore, the particular position can be recognized.

Also, the detecting means is not restricted to the probe 4, but may be a roller or a brush, and can also utilize an optical sensor, a magnetic sensor or the like. The number of the detecting means is not limited to one, but may be plural. Also, a plurality of the particular aspects of the electrodes may be provided at plural predetermined positions. Furthermore, a plural types of the particular aspects may be provided. Further, not only the changes in the above-described modes in which the widths of the electrodes are changed, but many other modes in which slits or codes are formed in the electrodes or different colors are used for the electrodes can be applied to the present invention.

As described above, in the sheet conveying apparatus and the image recording apparatus according to the present invention, an electrode at a particular position among a plurality of electrodes arranged in the conveying direction is formed in a particular aspect and design is made such that this electrode is detected, whereby it becomes possible to detect the position of the conveying belt and control the operation thereof without attaching a marker to the conveying belt. Therefore, the step of attaching a marker can be omitted and the curtailment of production cost can be achieved.

Also, particularly it becomes possible to recognize the position of the joining portion of the conveying belt to thereby control the conveying belt so that no sheet may be placed on the joining portion, and it becomes possible to avoid such inconveniences as bad images and jam.

What is claimed is:

1. A sheet conveying apparatus comprising:

a conveying belt for conveying a sheet;

a first group of electrodes having a plurality of electrodes arranged in a conveying direction of said conveying belt;

a second group of electrodes having a plurality of electrodes disposed among the plurality of electrodes of said first group of electrodes, said sheet being attracted by an electrostatic force produced with a potential difference provided between said first group of electrodes and said second group of electrodes, wherein an electrode at a particular position among said first group of electrodes and said second group of electrodes is formed in a particular aspect differing from an aspect of the other electrodes; and detecting means for detecting said particular aspect, said detecting means being provided in a movement path of said conveying belt.

2. A sheet conveying apparatus according to claim 1, wherein the aspect of said other electrodes is a pattern of the electrodes, and said particular aspect is a pattern of the electrode differing from the pattern of said other electrodes.

3. A sheet conveying apparatus according to claim 1, wherein said particular aspect is one in which an interval between the electrode at said particular position and the electrode adjacent thereto is made different from an interval between said other electrodes or a width of the electrode at said particular position is made different from a width of said other electrodes.

4. A sheet conveying apparatus according to claim 1, 2 or 3, wherein said detecting means detects said particular aspect by a difference in the interval between said electrodes passing it or the width of said electrodes.

5. A sheet conveying apparatus according to claim 4, further comprising control means for controlling an operation based on a detected information of said particular aspect by said detecting means.

6. A sheet conveying apparatus according to claim 5, further comprising feeding means for feeding the sheet to said conveying belt, wherein said feeding means feeds the sheet at a timing based on the detected information of said particular aspect by said detecting means.

7. A sheet conveying apparatus according to claim 6, wherein said feeding means feeds the sheet at the timing based on the detected information of said particular aspect by said detecting means to thereby feed the sheet to a position which does not overlie a joining portion of said conveying belt.

8. A recording apparatus for performing a record on a recording medium by using a recording head, said recording apparatus comprising:

a sheet conveying apparatus for conveying the recording medium to a position opposed to said recording head, said sheet conveying apparatus including:

a conveying belt for conveying a sheet;

a first group of electrodes having a plurality of electrodes arranged in a conveying direction of said conveying belt;

a second group of electrodes having a plurality of electrodes disposed among the plurality of electrodes of said first group of electrodes, said sheet being attracted by an electrostatic force produced with a potential difference provided between said first group of electrodes and said second group of electrodes, wherein an electrode at a particular position among said first group of electrodes and said second group of electrodes is formed in a particular aspect differing from an aspect of the other electrodes; and detecting means for detecting said particular aspect, said detecting means being provided in a movement path of said conveying belt.

9. A recording apparatus according to claim 8, wherein the aspect of said other electrodes is a pattern of the electrodes, and said particular aspect is a pattern of the electrode differing from the pattern of said other electrodes.

10. A recording apparatus according to claim 8, wherein said particular aspect is one in which an interval between the electrode at said particular position and the electrode adjacent thereto is made different from an interval between said other electrodes or a width of the electrode at said particular position is made different from a width of said other electrodes.

11. A recording apparatus according to claim 8, 9, or 10 wherein said detecting means detects said particular aspect by a difference in the interval between said electrodes passing it or the width of said electrodes.

12. A recording apparatus according to claim 11, further comprising control means for controlling an operation based on a detected information of said particular aspect by said detecting means.

13. A recording apparatus according to claim 12, further comprising feeding means for feeding the sheet to said conveying belt, wherein said feeding means feeds the sheet at a timing based on the detected information of said particular aspect by said detecting means.

14. A recording apparatus according to claim 13, wherein said feeding means feeds the sheet at the timing based on the detected information of said particular aspect by said detecting means to thereby feed the sheet to a position which does not overlie a joining portion of said conveying belt.

15. A recording apparatus according to claim 8, wherein said recording head is a head of an ink jet recording system type.

* * * * *

UNITED STATES PATENT AND TRADEMARK OFFICE

CERTIFICATE OF CORRECTION

PATENT NO. : 6,332,612 B1
DATED : December 25, 2001
INVENTOR(S) : Shoji Kanemura It is certified that error appears in the above-identified patent and that said Letters Patent is hereby corrected as shown below:

Column 5,
Line 22, "great" should read -- greater --.

Signed and Sealed this

Fourteenth Day of May, 2002

*Attest:*

*Attesting Officer*

JAMES E. ROGAN
*Director of the United States Patent and Trademark Office*